US006302566B1

(12) United States Patent
Cohon

(10) Patent No.: US 6,302,566 B1
(45) **Date of Patent: *Oct. 16, 2001**

(54) REMOVABLE LAMPSHADE DRAPE

(76) Inventor: Richard Cohon, 600 Summit Ave., Hackensack, NJ (US) 07601

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/358,225

(22) Filed: Jul. 21, 1999

(51) Int. Cl.[7] ..... F21V 11/00
(52) U.S. Cl. ..... 362/351; 362/355; 362/360
(58) Field of Search ..... 362/351, 352, 362/355, 356, 357, 358, 359, 360, 256; D26/109

(56) References Cited

U.S. PATENT DOCUMENTS

| | | | | |
|---|---|---|---|---|
| 400,372 | * | 3/1889 | Tank | 362/351 |
| 524,825 | | 8/1894 | Hohenstein | 362/357 |
| 548,373 | | 10/1895 | Lemay | 362/357 |
| 824,444 | * | 6/1906 | Schurek | 362/351 |
| 1,580,922 | * | 4/1926 | Scherer | 362/351 |
| 2,224,950 | * | 12/1940 | Burke | 362/352 |
| 2,498,097 | * | 2/1950 | Scherer | 362/351 |
| 2,516,286 | * | 7/1950 | Yeidel | 362/352 |
| 3,385,963 | * | 5/1968 | Washick | 362/351 |
| 4,068,120 | * | 1/1978 | Throckmorton et al. | 362/351 |
| 4,079,245 | * | 3/1978 | Baker | 362/355 |
| 4,731,715 | * | 3/1988 | Anderson | 362/352 |
| 4,731,716 | * | 3/1988 | Chang | 362/352 |
| 5,311,415 | * | 5/1994 | Hyland | 362/352 |
| 5,662,412 | * | 9/1997 | Glendmyer | 362/351 |
| 5,702,180 | * | 12/1997 | Huang | 362/410 |
| 5,711,599 | * | 1/1998 | Teng | 362/358 |
| 5,746,506 | | 5/1998 | Dunbar | 362/351 |
| 5,909,954 | * | 6/1999 | Thomas | 362/351 |

FOREIGN PATENT DOCUMENTS

| | | | | |
|---|---|---|---|---|
| 838585 | * | 5/1952 | (DE) | 362/355 |
| 0325878 | * | 8/1989 | (EP) | 362/352 |

* cited by examiner

*Primary Examiner*—Sandra O'Shea
*Assistant Examiner*—Peggy A Neils
(74) *Attorney, Agent, or Firm*—Kirschstein, et al.

(57) ABSTRACT

A drape is maintained at a distance from, and out of contact with, an exterior surface of a lampshade of an electrical lamp. The drape is mounted on a support which, in turn, is mounted on the lampshade and/or the lamp. The support has extensions that extend beyond the exterior surface. The drape is suspended from the extensions. Different drapes create different appearances for the lamp.

17 Claims, 2 Drawing Sheets

REMOVABLE LAMPSHADE DRAPE

BACKGROUND OF THE INVENTION

1. Field of the Invention

The present invention generally relates to an arrangement for and a method of covering a shade of an electrical lamp with a drape and, more particularly, to substituting one decorative drape for another to create a desired, decorative appearance for the lamp.

2. Description of the Related Art

Lampshades are made of many different materials supported by a frame and, in the case of a fabric lampshade, the fabric is stretched about a metal frame that can be made in all different shapes and sizes, including cylindrical, conical, box-like and like geometrical configurations. See, for example, U.S. Pat. Nos. 524,825 and 548,373. The fabric may be neutral in color to match any room decor, or may be patterned and colored to coordinate the appearance of the lampshade with other room furnishings. Over time, the lampshade may become discolored or outdated so that replacement is desirable.

Although purchasing a new lampshade is a prevalent option, the art contains examples of kits or covers that permit a user to change the appearance of an existing lampshade. Such removable covers are disclosed in, for example, U.S. Pat. Nos. 4,731,715, 5,662,412 and 5,746,506 in which elastic bands, drawstrings and Velcro™-type fasteners are used to tightly secure at least part of the cover to the existing lampshade material. The areas of contact between the cover and the lampshade material become dark when the bulb is turned on, and create undesirable shadows that are objectionable for a lampshade whose purpose is to uniformly diffuse the light. Such shadow effects have not led to the widespread adoption of the known lampshade covers.

SUMMARY OF THE INVENTION

Objects of the Invention

Accordingly, it is a general object of this invention to cover a lampshade with a drape without producing objectionable shadows.

More particularly, it is an object of the present invention to easily replace one lampshade drape with another to coordinate the drape to any room decor.

Still another object of the present invention is to create a decorative, optical effect on any lamp.

It is yet another object of the present invention to easily change the ornamentation of any lampshade without having to purchase a new lampshade.

Features of the Invention

In keeping with the above objects and others which will become apparent hereafter, one feature of the present invention resides, briefly stated, in an arrangement for, and a method of, covering an exterior surface of a shade of an electrical lamp. A support is supported by the shade and/or the lamp. The support has an extension that extends beyond the exterior surface of the shade to be covered. A drape is suspended from the extension and is maintained at a distance from, and out of contact with, the exterior surface of the shade.

Hence, in accordance with this invention, by maintaining the drape out of contact with the exterior surface of the shade to be covered, no undesirable shadows or dark zones are produced on the shade. Light emitted from a bulb passes through the shade, which is typically made of a thin, light-transmissive material, and then through a spacing between the shade and the drape, before passing through the drape which is likewise preferably constituted of a thin, light-transmissive material. Some of the light is reflected off an inner surface of the drape. This reflected light is reflected a number of times between the exterior surface of the shade and the inner surface of the drape, and creates a soft, diffuse optical effect devoid of shadow and a uniform backlighting for any ornamentation on the drape.

In a preferred embodiment, especially for use with a shade having a four-sided cross-section, the extension has a first pair of arms spaced apart of each other along a first longitudinal axis, and a first rod extending along the first longitudinal axis between the first pair of arms. The drape has a first hanging drape portion constituted of a sheet material draped over the first rod and maintained at the distance from a first side of the exterior surface of the shade. The extension also has a second pair of arms spaced apart of each other along a second longitudinal axis parallel to the first longitudinal axis, and a second rod extending along the second longitudinal axis between the second pair of arms. The drape has a second hanging drape portion constituted of a sheet material draped over the second rod and maintained at the distance from a second side, opposite to the first side, of the exterior surface of the shade.

The drape further has a top drape portion constituted of a sheet material and extending between the first and second hanging drape portions. The top drape portion is supported in a generally horizontal plane between the first and second rods. A central aperture is preferably formed in the top drape portion to allow the escape of heat and rising air currents.

The drape is a sheet material, preferably a soft fabric that is capable of hanging in a manner resembling a curtain. Any pattern or like ornamentation may be on the fabric. Replacing one patterned fabric for another is as simple as removing one drape from the support and placing another drape thereon.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
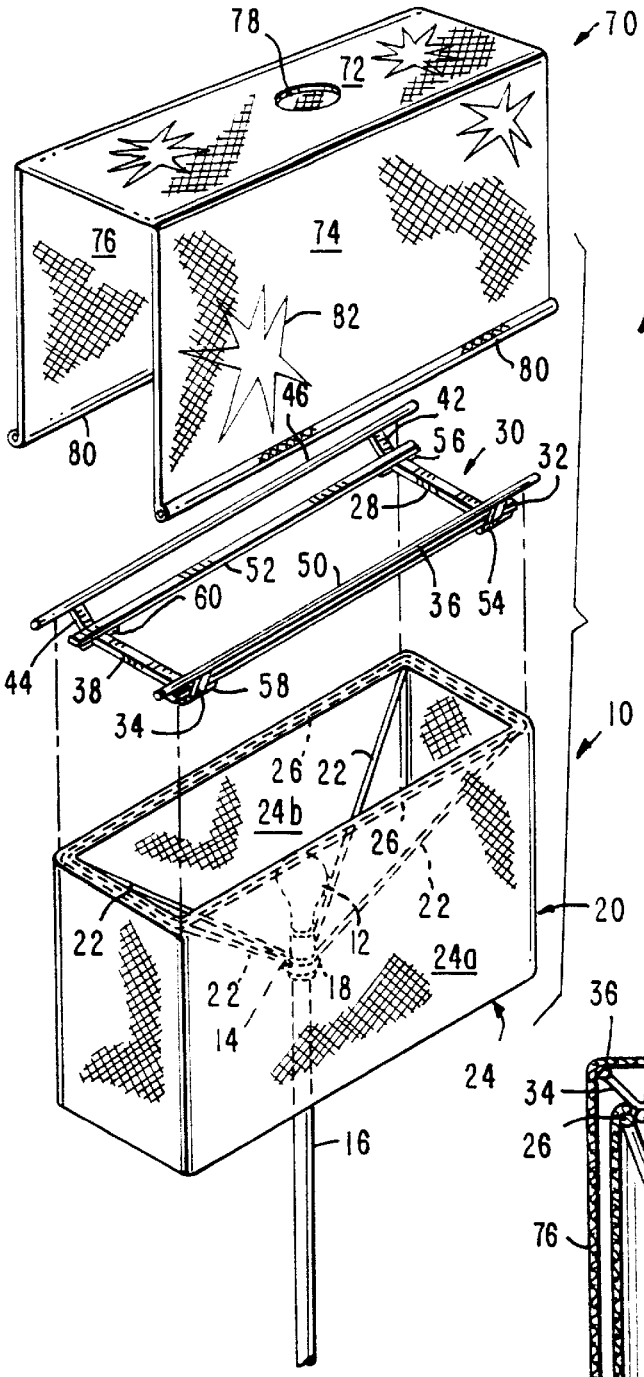
FIG. 1 is an exploded, perspective view of an arrangement for covering a shade of an electrical lamp in accordance with the method of this invention.

Referring to the drawings, reference numeral 10 generally identifies an electrical lamp having an electric light bulb 12 mounted in a bulb socket 14 supported by an upright pole 16. A lampshade 20 is mounted on the lamp 10 to screen the light emitted by the bulb. The lampshade 20 is supported on the lamp by a mounting ring 18 that snugly fits about the socket 14, and plurality of elongated braces 22 that extend from the ring 18 to the lampshade.

This invention is intended to be used for a variety of lamps, including, without limitation, table lamps, floor lamps and desk lamps. This invention is also intended to be used for a diversity of lampshades of various shapes and sizes. For example, the lampshade shown in FIG. 1 has a rectangular cross-section. However, it will be understood that the cross-section for the lampshade can be square, circular, oval, triangular and, in brief, any closed geometrical figure. Although the illustrated lampshade has a box-like shape, other shapes, such as cylindrical, conical, pyramidal and the like are also contemplated.

As illustrated, the lampshade 20 comprises a thin, fabric 24 of light-transmissive material stretched taut on a frame 26. The fabric 24 is typically a cloth, such as silk, muslin, linen and the like. Non-fabric materials, such as glass, plastic and the like, could also be used for the lampshade material. Indeed, even opaque materials, such as stones or shells can be used, provided openings for the passage of light are furnished.

The support for the lampshade can likewise be varied from the illustrated ring and braces structure. Another popular support is a harp that extends from the socket 14 vertically above the bulb. The lampshade frame is then made with a ring through which a threaded post of the harp extends. A nut is threaded onto the threaded post to anchor the lampshade frame in place.

The bulb 12 need not be an incandescent bulb, but can be any of the myriad light sources that are energizable to emit light.

As described so far, the lamp 10, the lampshade 20 and its supporting structure are entirely conventional. In order to change the appearance of the lampshade without purchasing a new one, this invention proposes an arrangement for, and a method of, covering an exterior surface of the lampshade by mounting a support 30 on the lampshade 20 and/or the lamp 10, and by mounting a drape 70 on the support 30, as detailed below.

Figure 3:
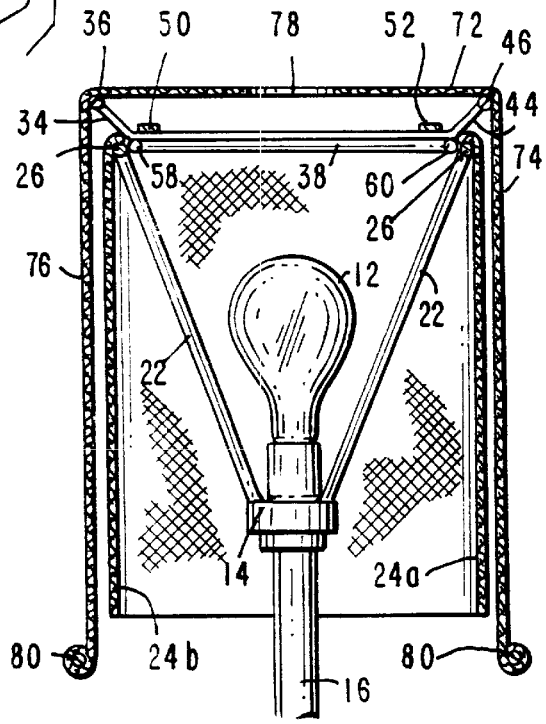
FIG. 3 is a sectional view, on a reduced scale, as taken on line 3—3 of FIG. 2.

As best seen in FIG. 1, the support 30 includes a first pair of arms 32, 34 spaced apart of each other along a first longitudinal direction, and a first rod 36 extending along the first longitudinal direction between, and preferably past, the arms 32, 34. The arms 32, 34 and the rod 36 constitute a first extension that, as seen in FIG. 3, extends beyond an exterior front surface 24*a* of the lampshade.

FIG. 1 also illustrates that the support 30 further includes a second pair of arms 42, 44 spaced apart of each other along a second longitudinal direction parallel to the first direction, and a second rod 46 extending along the second longitudinal direction between, and preferably past, the arms 42, 44. The arms 42, 44 and the rod 46 constitute a second extension that, as seen in FIG. 3, extends beyond an exterior rear surface 24*b* of the lampshade.

The first and second extensions thus extend in opposite transverse directions past the opposite front and rear, exterior surfaces of the lampshade. The first and second extensions are connected by a pair of transverse elements 28, 38 and a pair of longitudinal elements 50, 52. Element 28 is co-linear with arms 32, 42. Element 38 is co-linear with arms 34, 44. The elements 28, 38, 50, 52 generally lie in a horizontal plane. The arms 32, 34, 42, 44 extend upwardly from this horizontal plane. The rods 36, 46 are elevated above this horizontal plane.

A plurality of mounting elements 54, 56, 58, 60 are connected at the underside of the support 30. Elements 54, 58 are longitudinally spaced apart underneath the arms 32, 34. Elements 56, 60 are longitudinally spaced apart underneath the arms 42, 44. The support 30 is preferably constituted of a rigid material, such as metal, preferably coated with a coating. The longitudinal elements, the transverse elements and the arms are preferably constituted of a flat stock. The rods and the mounting elements are preferably constituted of a round stock. All the elements, rods and arms of the support are interconnected, preferably by welding.

To mount the support 30 on the lampshade 20, the mounting elements 54, 56, 58, 60 are forced downwardly into the upper, open end of the lampshade until the mounting elements engage by snap action the frame 26 and, more particularly, the annular frame portion of the frame 26 that bounds the upper, open end of the lampshade. The frame 26 is typically constituted of a resilient material and, hence, the annular frame portion yields outwardly as the mounting elements are forced down onto the lampshade, and returns due to its inherent resilience to snappingly engage the mounting elements.

Other mountings for the support 30 are contemplated for this invention. For example, the support 30 could be connected to the annular frame portion of the frame 26 by a resilient clip or analogous fastener. The support could be connected directly to one or more of the braces 22, the mounting ring 18, the socket 14, the pole 16, or even to the bulb 12. In the aforementioned case of a harp, the support 30 could be mounted directly to the harp. In some applications, Velcro™-type fasteners or adhesive tapes may be employed.

The drape 70 is draped over the support 30 and, as detailed below, is maintained at a distance from, and out of contact with, the exterior surface of the lampshade to be covered. The drape 70 is preferably a fabric material that is capable of hanging from the support. Cloth, such as silk, cotton, muslin and like materials, is preferred, although it will be understood that any light-transmissive material, such as paper, as well as non-fabric materials, such as glass and plastic, could be used.

As illustrated, the drape 70 has a top portion 72 overlying the top of the support in a generally horizontal plane, a first hanging drape portion 74 overlying the first rod 36 and suspended therefrom in a generally vertical plane spaced from the exterior front surface 24*a* of the lampshade, and a second hanging drape portion 76 overlying the second rod 46 and suspended therefrom in a generally vertical plane spaced from the exterior rear surface 24*b* of the lampshade. The top portion 72 has a central aperture 78 through which heated air currents may rise to prevent localized overheating of the drape at the top portion 72.

As best seen in FIG. 3, the hanging drape portions 74, 76 preferably vertically extend below a lower, open end of the lampshade. The bottom regions 80 of the hanging drape portions 74, 76 are preferably weighted to insure that the drape portions 74, 76 lie flat without exhibiting creases and wrinkles. Weighting of the bottom regions can be obtained by curling the bottom regions to form a heavy, lower edge, or by sewing a weight in a folded hem of the drape portions 74, 76. The drape portions 74, 76 could also be sized to terminate at the lower end of the lampshade.

Figure 2:
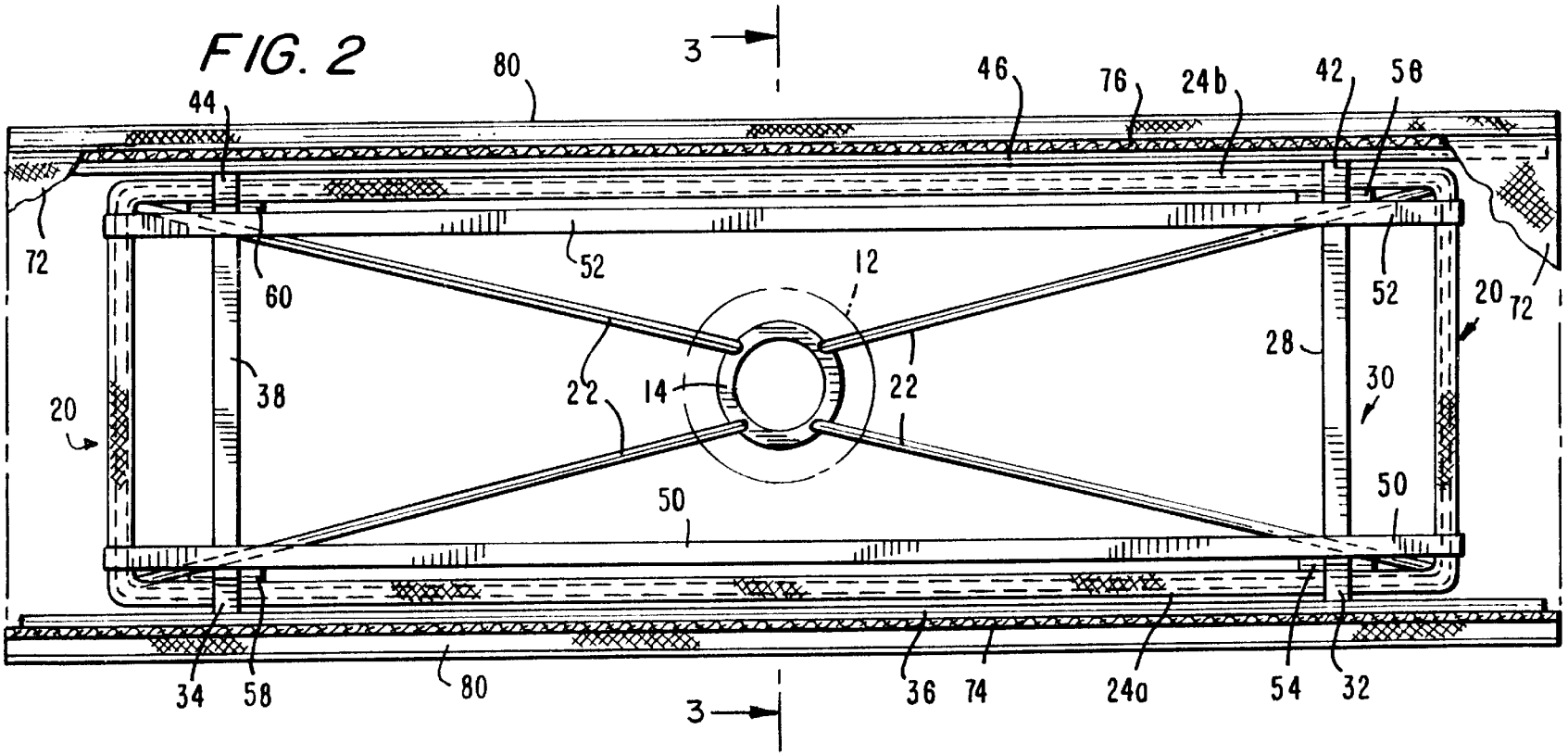
FIG. 2 is a partially broken-away, top plan view, on an enlarged scale, of the assembled arrangement of FIG. 1.

As best seen in FIG. 2, the hanging drape portions 74, 76 preferably horizontally extend past both opposite side walls of the lampshade. The drape portions 74, 76 could also be sized to terminate at the side walls of the lampshade.

The drape 70 itself can hold its position on the support 30 and about the lampshade. To insure that the drape will not fall from the support, the inner surface of the drape and/or the rods 36, 46 may be treated with an anti-slip coating, or roughened to increase the friction between the drape and the support and thus keep the drape in place. Adhesives or mechanical fasteners, although not preferred, could also be used to retain the drape.

As described so far, the drape only covers the front and rear surfaces of the lampshade. It will be understood that the exterior surface of the lampshade to be covered may consist of only one of the front and rear surfaces, or one of the side surfaces, or may consist of all the exterior surfaces, of the lampshade. For example, if it is desired to cover the side walls of the lampshade, then the drape will include two more hanging drape portions at opposite ends of the top portion 72.

The drape may be neutral in color or pattern, but preferably, ornamentation 82 is provided on the drape. The ornamentation can be any decoration or embellishment, especially artwork or a pattern printed on the drape. A drape bearing one ornamentation can easily be replaced by another drape bearing a different ornamentation, thereby allowing the lampshade to be coordinated to any room decor as often as one likes. Indeed, the drape can be a fabric that is used to cover a couch or chair. The use of the very same fabric to cover both an item of furniture and a lampshade makes for a matched room setting.

In case the lampshade has a different shape, such as a frusto-conical shape, then the drape will similarly be configured to have a complementary contour. In all cases, the drape is kept at a distance from the lampshade.

Again, referring to FIG. 3, light is emitted from the bulb in all directions and passes through the light-transmissive material of the lampshade to the drape. A portion of the light incident on the drape passes therethrough. Another portion of the incident light is reflected from the interior surface of the drape back to the lampshade. The light may reflect a number of times between the drape and the lampshade, thereby creating a uniform, shadowless backlighting against which the ornamentation 82 is illuminated.

It will be understood that each of the elements described above, or two or more together, also may find a useful application in other types of constructions differing from the types described above.

While the invention has been illustrated and described as embodied in a removable lampshade drape, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An arrangement for covering a n exterior surface of a shade of an electrical lamp, comprising:

a) a support supported by at least one of the shade and the lamp, the support having an extension that extends beyond the exterior surface of the shade to be covered; and b) a drape having first and second hanging drape portions each suspended from the extension in a generally vertical plane, and maintained at a distance from, and out of contact with, the exterior surface of the shade, and a top drape portion extending between the first and second hanging drape portions in a generally horizontal plane.

2. The arrangement according to claim 1, wherein the support includes mounting elements that engage the shade.

3. The arrangement according to claim 2, wherein the extension has a first pair of arms spaced apart of each other along a first longitudinal axis, and a first rod extending along the first longitudinal axis between the first pair of arms; and wherein the drape has a first hanging drape portion constituted of a sheet material draped over the first rod and maintained at the distance from a first side of the exterior surface of the shade.

4. The arrangement according to claim 3, wherein the extension has a second pair of arms spaced apart of each other along a second longitudinal axis parallel to the first longitudinal axis, and a second rod extending along the second longitudinal axis between the second pair of arms; and wherein the second hanging drape portion is constituted of a sheet material draped over the second rod and maintained at the distance from a second side, opposite to the first side, of the exterior surface of the shade.

5. The arrangement according to claim 4, wherein the first and second rods are elevated above the mounting elements.

6. The arrangement according to claim 5, wherein the top drape portion constituted of a sheet material extending between the first and second rods.

7. The arrangement according to claim 1, wherein the top drape portion has a central aperture.

8. The arrangement according to claim 1, wherein the drape is constituted of a sheet material.

9. The arrangement according to claim 8, wherein the sheet material is a fabric having ornamentation thereon.

10. The arrangement according to claim 1, wherein each hanging drape portion extends below the shade.

11. The arrangement according to claim 1, wherein each hanging drape portion has a weighted lower edge region to maintain each hanging drape portion taut.

12. An arrangement for covering opposite exterior surfaces of a shade of an electrical lamp, comprising:

a) a support supported by at least one of the shade and the lamp, the support having opposite extensions that extend entirely beyond the opposite exterior surfaces of the shade to be covered; and b) a drape constituted of a sheet material and having a top drape portion extending in a generally horizontal plane between the extensions, and opposite hanging drape portions suspended from the extensions in generally vertical planes and maintained at distances from, and out of contact with, the opposite exterior surfaces of the shade.

13. The arrangement according to claim 12, wherein the extensions have respective rods over which the drape is supported, and wherein the rods are elevated above the shade.

14. The arrangement according to claim 12, wherein the drape is a fabric having ornamentation thereon.

15. A method of decoratively covering an exterior surface of a shade of an electrical lamp, comprising the steps of:

a) mounting a support on at least one of the shade and the lamp, the support having an extension that extends entirely beyond the exterior surface of the shade to be covered; and b) supporting a drape from the extension by suspending therefrom hanging drape portions each lying in a generally vertical plane and maintaining the hanging drape portions at a distance from, and out of contact with, the exterior surface of the shade, and by extending a top drape portion between the hanging drape portions in a generally horizontal plane.

16. The method according to claim 15, wherein the supporting step is performed by laying the drape over the support and allowing the hanging drape portions of the drape to hang.

17. The method according to claim 15, wherein the supporting step is performed by replacing the drape with another drape, each drape having a different ornamentation thereon.

* * * * *